US009949556B2

(12) United States Patent
Raske

(10) Patent No.: US 9,949,556 B2
(45) Date of Patent: Apr. 24, 2018

(54) PROTECTIVE BARRIER HANGER SYSTEM

(71) Applicant: Austin Raske, Homewood, IL (US)

(72) Inventor: Austin Raske, Homewood, IL (US)

( * ) Notice: Subject to any disclaimer, the term of this patent is extended or adjusted under 35 U.S.C. 154(b) by 74 days.

(21) Appl. No.: 14/863,939

(22) Filed: Sep. 24, 2015

(65) Prior Publication Data

US 2016/0100672 A1 Apr. 14, 2016

Related U.S. Application Data

(60) Provisional application No. 62/063,473, filed on Oct. 14, 2014, provisional application No. 62/066,249, filed on Oct. 20, 2014.

(51) Int. Cl.
*A45F 3/10* (2006.01)
*F41C 33/02* (2006.01)

(52) U.S. Cl.
CPC ..... *A45F 3/10* (2013.01); *F41C 33/02* (2013.01)

(58) Field of Classification Search
CPC ..... A45F 3/04; A45F 3/06; A45F 3/10
USPC ..... 224/650, 651, 261–263, 633–635, 637, 224/575–577, 153, 438, 922, 645, 913; D3/216; 220/9.1–9.4
See application file for complete search history.

(56) References Cited

U.S. PATENT DOCUMENTS 1,890,983 A * 12/1932 Griffith ..... B65D 7/26 220/485
2,946,452 A * 7/1960 Caloiero ..... A47B 81/005 211/4
3,815,118 A * 6/1974 McDonald ..... A45C 13/24 200/DIG. 2
3,902,640 A * 9/1975 Geiben ..... A45F 3/04 224/148.4
3,913,746 A * 10/1975 Burton ..... A47B 81/005 211/64
4,830,245 A 5/1989 Arakaki
4,854,432 A * 8/1989 Carpenter ..... A45C 13/02 190/110
5,161,722 A * 11/1992 Hembree ..... A45F 3/08 224/148.2
5,975,389 A * 11/1999 Braun ..... A01M 31/02 182/187
6,217,113 B1 * 4/2001 Knatz ..... A47C 4/52 224/155
8,162,194 B2 4/2012 Gleason
8,381,956 B2 2/2013 Gleason, Jr.
9,078,503 B1 * 7/2015 Gilman ..... A45C 13/20
2005/0163403 A1 * 7/2005 Piscioneri ..... A45C 3/001 383/108
2009/0014490 A1 1/2009 Bradley

* cited by examiner

*Primary Examiner* — Adam Waggenspack

(74) *Attorney, Agent, or Firm* — Katten Muchin Rosenman LLP

(57) ABSTRACT

According to at least one exemplary embodiment, a pack comprises an outer fabric shell having a top flap foldably coupled thereto; and a frame assembly, said frame assembly comprising a back wall barrier, a first sidewall cage frame hingedly coupled to said back wall barrier, a second sidewall cage frame hingedly coupled to said back wall barrier, and a plurality of support bars connecting the first sidewall cage frame with the second sidewall cage frame, wherein the outer fabric shell is configured to cover said frame assembly.

12 Claims, 16 Drawing Sheets

PROTECTIVE BARRIER HANGER SYSTEM

This application claims priority to U.S. Patent Application No. 62/063,473, filed Oct. 14, 2014, and to U.S. Patent Application No. 62/066,249, filed Oct. 20, 2014, the contents of both applications are incorporated herein by reference.

TECHNICAL FIELD

The present invention relates to packs that can be carried and can hold equipment and supplies. More specifically, the present invention further relates to heavy-duty packs that can be carried by military personnel and can hold ammunition, supplies, and lifeline equipment in a safe and effective way.

BACKGROUND

Current backpacks, assault packs, and carrying packs use inexpensive material of poor quality with poor stitching in order to keep costs down. These inexpensive packs are delicate, and their parts, such as their carrying handles, are prone to tear apart while being used in critical situations, such as in remote mountainous areas and war zones.

Examples of existing military grade packs include, for example: U.S. Pat. No. 4,830,245, which describes a military backpack with a large rectangular frame; U.S. Pat. Pub. No. 2009/0014490, which describes a bulletproof backpack; U.S. Pat. No. 8,162,194, which describes a backpack with side bolsters; and U.S. Pat. No. 8,381,956, which describes a backpack frame assembly and associated load carrying devices.

Prior attempts to improve packs, such as the foregoing and systems that allow a user to hang equipment from a pack via looped and stitched cloth, are substandard. The present invention solves the problems associated with present packs by protecting every element of the pack while further protecting the equipment carried by the pack. The present invention can also improve pack durability by incorporating tough interior and exterior materials, which can also improve protection of equipment carried by the pack.

SUMMARY OF THE INVENTION

The present disclosure is a pack that protects hanging equipment and includes a monopod holder slot.

According to at least one exemplary embodiment, a pack comprises an outer fabric shell having a top flap with metal in-casing foldably coupled thereto; and a frame assembly, said frame assembly comprising a back wall barrier, a first sidewall cage frame weldedly or bendably coupled to said back wall barrier, a second sidewall cage frame hingedly coupled to said back wall barrier, and a plurality of support bars connecting the first sidewall cage frame with the second sidewall cage frame, wherein the outer fabric shell is configured to cover said frame assembly.

DESCRIPTION OF THE DRAWINGS

These and other advantages of the present invention will be readily understood with reference to the following specifications and attached drawings wherein.

DETAILED DESCRIPTION

Preferred embodiments of the present invention will be described hereinbelow with reference to the accompanying drawings. In the following description, well-known functions or constructions are not described in detail because they may obscure the invention in unnecessary detail. The present invention relates to packs that can be carried and can hold equipment and supplies.

As used herein, the word "exemplary" means "serving as an example, instance, or illustration." The embodiments described herein are not limiting, but rather are exemplary only. It should be understood that the described embodiments are not necessarily to be construed as preferred or advantageous over other embodiments. Moreover, the terms "embodiments of the invention," "embodiments," or "invention" do not require that all embodiments of the invention include the discussed feature, advantage, or mode of operation.

The term "as worn" as used herein shall be understood to refer to the ordinary position of a school backpack while one wears it in relation to the wearer.

The term "lipped" means having material that overlaps an edge for protection and better sealing of a pocket, pouch, or other area.

Figure 1A:
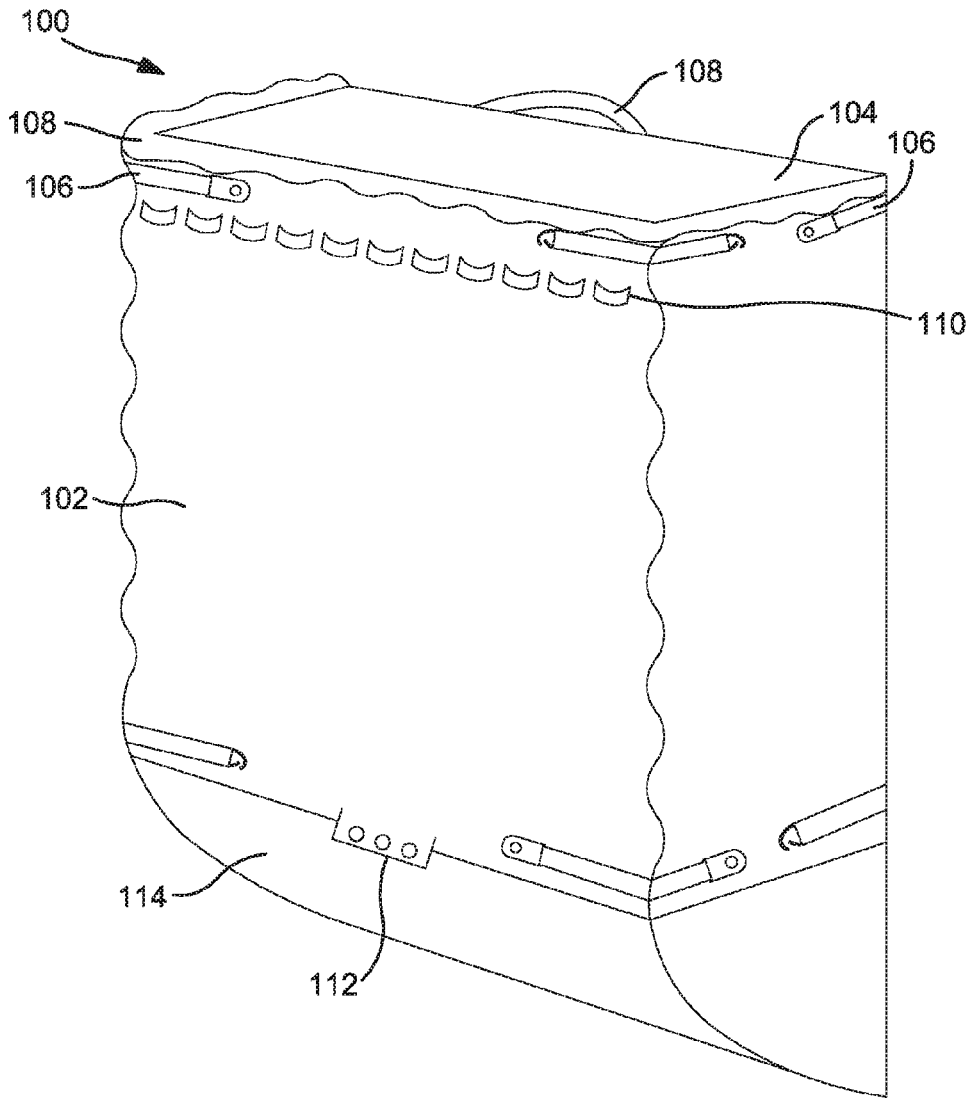
FIG. 1*a* is a front exterior perspective view of an exemplary embodiment.

FIG. 1*a* illustrates a perspective view of an exemplary embodiment of a pack 100 that can be carried and can hold equipment and supplies. As illustrated, the pack 100 may comprise an outer fabric shell 102 that may further comprise a durable fabric attached to an inner frame via sewing or binding at different areas. The outer fabric shell 102 may surround the exterior of the pack 100. The outer fabric shell 102 may be detachable and securely attached to a top flap 104, which may comprise durable fabric. Example flexible, durable sheet-like materials suitable for fabricating the outer fabric shell 102, flaps and/or other components, include, for example, leather, fabric (e.g., canvas), polymers (e.g., polyester, nylon, ballistic nylon, Cordura 1000 Super Durable Water Resistant Nylon by Invista, etc.), fabric, or combinations thereof. The materials may be woven, stamped, molded, or in various other forms known in the art.

The top flap 104 may be attached to the outer fabric shell 102 on the right side of the pack 100 as worn via snap connector straps 106 which may have extensions. The top flap 104 may have a lipped edge 108 to seal gaps between the top flap 104 and the outer fabric shell 102. Further, the top flap 104 may have a small groove (not shown) where an antenna would hang out of to facilitate a path of least resistance down to the side of the pack and could be secured by other straps, nylon webbing, or hanger loop a doops. The top flap 104 may further comprise an inner pocket with a hook-and-loop-fastener-lined button flap. The inner pocket may be fully contained within the top flap 104. Suitable hook-and-loop fasteners are available. The top flap 104 may employ durable fabric strips that connect to inner/outer canvas, horizontally, vertically, connected or separate from the snap connector straps 106.

Connector straps 106 may be used to secure items to the side of the pack 100, such as a radio antenna. Hanger loops 110, preferably formed from nylon webbing or other suitable material, can be used to secure items to pack 100. Hanger loops 100 can also aid in securing outer fabric shell 102 to the inner frame assembly of pack 100.

In certain aspects, quick-release buckles may be used to close off, or otherwise secure, a first component of the pack to a second component of the pack. A benefit of the quick-release buckle is that it enables a wearer to quickly and easily separate and reattach extensions of the embodiment and or items attached. However, other mechanisms are contemplated, such as, snaps, clips, magnets (e.g., a magnetic buckle or magnetic snaps), cam buckles, traditional buckles, adjustable hinged buckles, or any other latching/buckling mechanism known in the art of backpack/bag/purse design may serve the general function of buckle.

A carrying handle 108 may be attached to the pack frame and may comprise a durable fabric with padding. The carrying handle 108 may also comprise a stitched, durable fabric strap attached to any point of the pack frame.

Figure 9A:
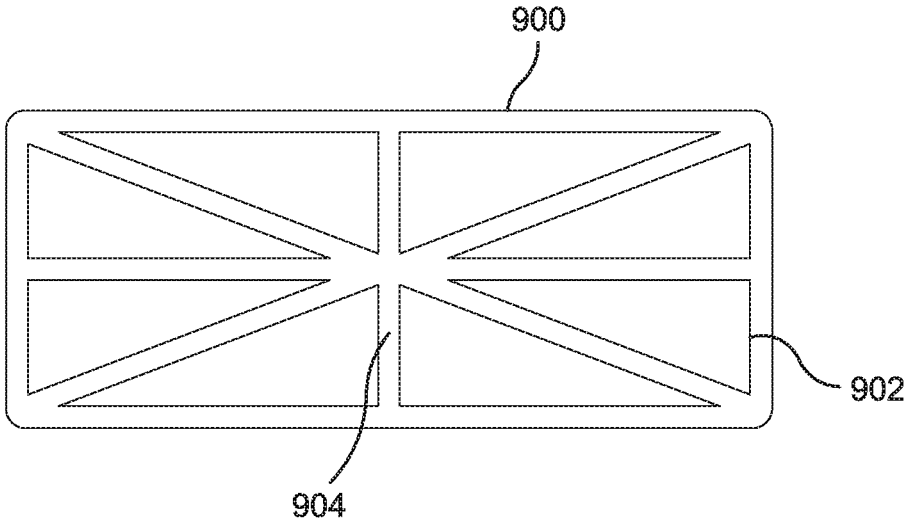
FIG. 9*a* is a sectional view of a exemplary embodiment showing only showing the inside bottom structural star that acts as a load bearing and weight dispersing surface.

As depicted in FIG. 1*a*, pack 100 further comprises closure 112, such as a button closure, which is used to secure monopod pocket 114. Closure 112 may be located anywhere along the lower portion of outer fabric shell 102 and may be waterproof or just comprised of metal ring/s like the section of a hollow metal pipe attached to bottom of shelf 900 (FIG. 9*a*). Monopod pocket 114 may be configured to have a universal or specific fit for a monopod or section of a tripod/bipod.

Figure 1B:
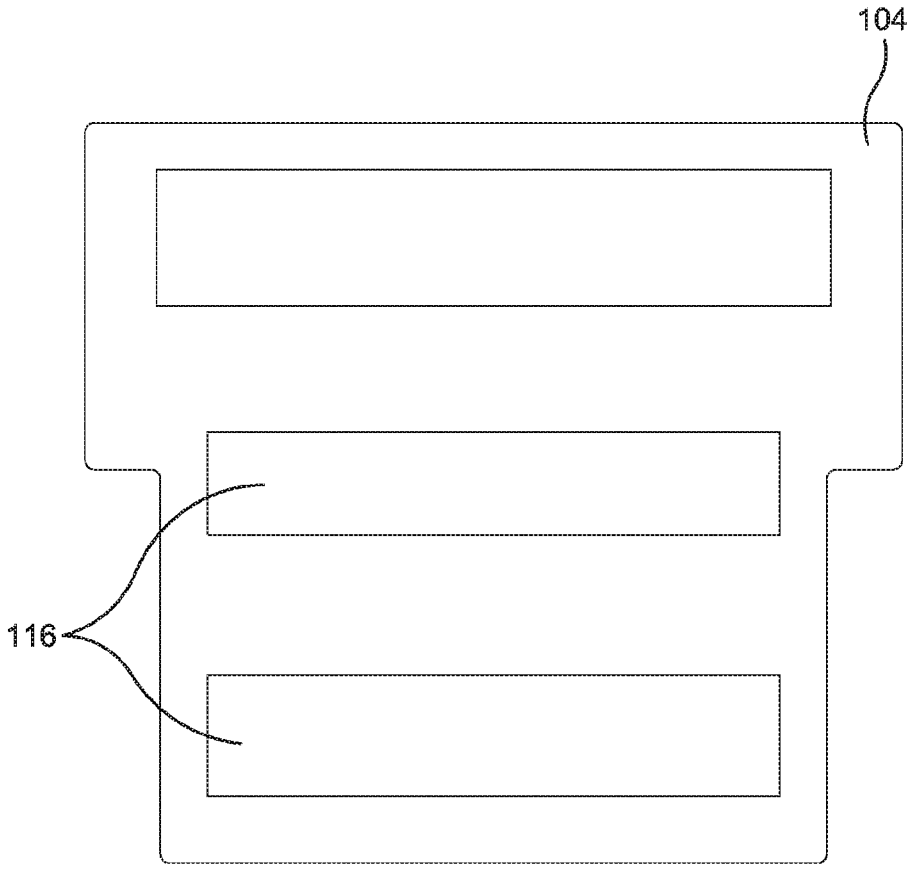
FIG. 1*b* is a front view of a top flap plate as found as detached from an exemplary embodiment.

FIG. 1*b* depicts a view of top flap 104 without a covering. As shown, top flap 104 is generally rectangular in shape and comprises openings 116 which help to reduce the weight of pack 100 while also providing structural support. Top flap 104 is preferably formed from a single piece of metal, such as 6061,5052 aluminum or titanium, which is cut by a water jet machine. However, other manufacturing techniques, such as stamping may also be utilized. For example, the pack frame, such as top flap 104, may be formed from aluminum barrier tubes that are welded together into the desired shape.

In some embodiments, top flap 104 is formed from a lightweight plastic of carbon fiber material if top flap 104 does not need to be weight bearing. The covering for top flap 104 may be the same or a different material than that of outer fabric shell 102. For example, in some embodiments, it may be preferable to cover top flap 104 with a waterproof material to keep water out of the interior of pack 100.

Figure 2A:
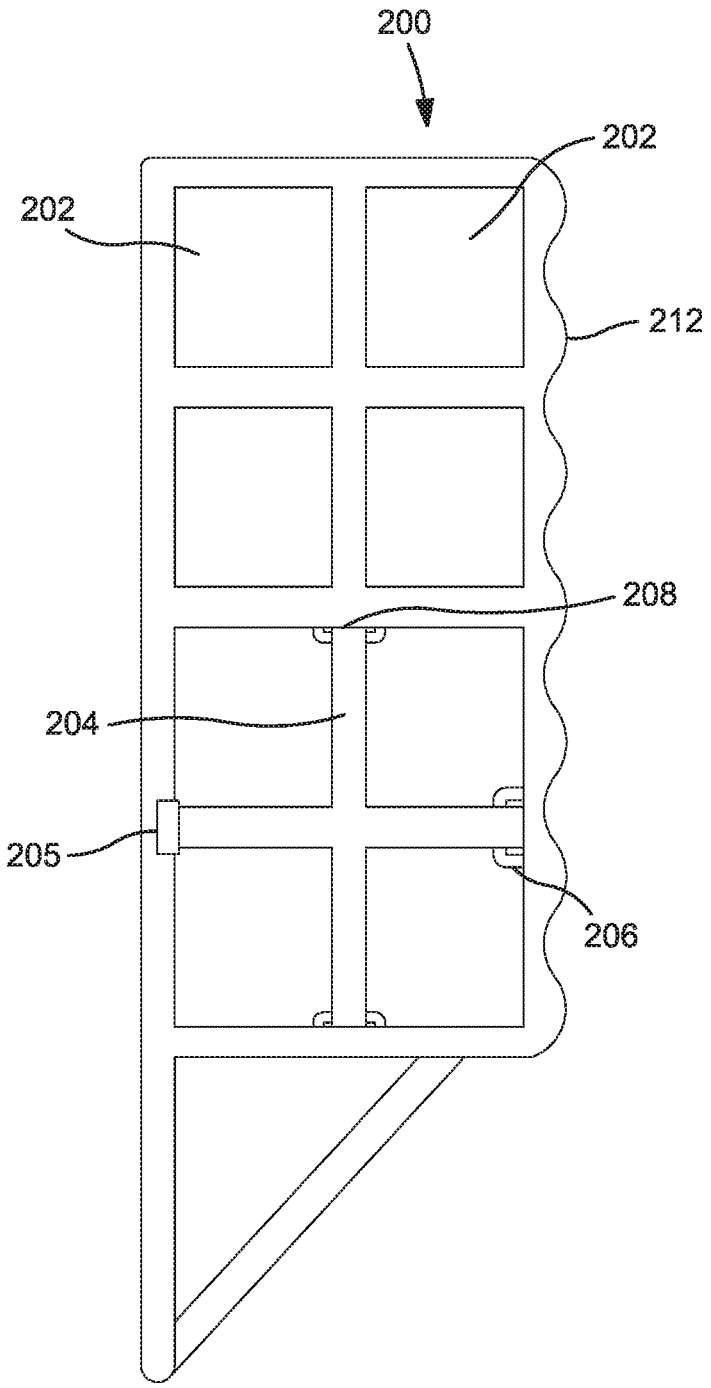
FIG. 2*a* is an interior view of a left sidewall cage frame as found in an exemplary embodiment.

FIG. 2*a* is a view of a left sidewall cage frame 200 as found in an exemplary embodiment shown with outer fabric shell 102 removed. Similar to top flap 104, left sidewall cage frame 200 also has a plurality of rectangular openings 200 which help to reduce the weight of pack 100 without comprising stability. Left sidewall cage frame 200 is preferably formed in a similar manner and from similar materials to that of top flap 104.

Left sidewall cage frame 200 also comprises door 204 which is secured to left sidewall cage frame 200 by hinge 205. Door 204 allows access to the interior of pack 100 when top flap 104 is in an inconveniently closed position. Hinge 205 may comprises stoppers to restrict door 204 from exceeding a rotation greater than one hundred eighty degrees relative to its closed position.

Door 204 is held in a closed position by grippers 206 on left sidewall cage frame 200 which engages with holders 208 on door 204 to create a temporary lock. Grippers 206 and holders 208 may be any elements of known size and shape which can be used to cause door 204 to remain in a closed position. The area beneath the door 204 may comprise extensions of 6061 flat bar aluminum or other material to act as legs on the outer edges of the interior pack frame to help hold up the pack or to add strength.

Figure 2B:
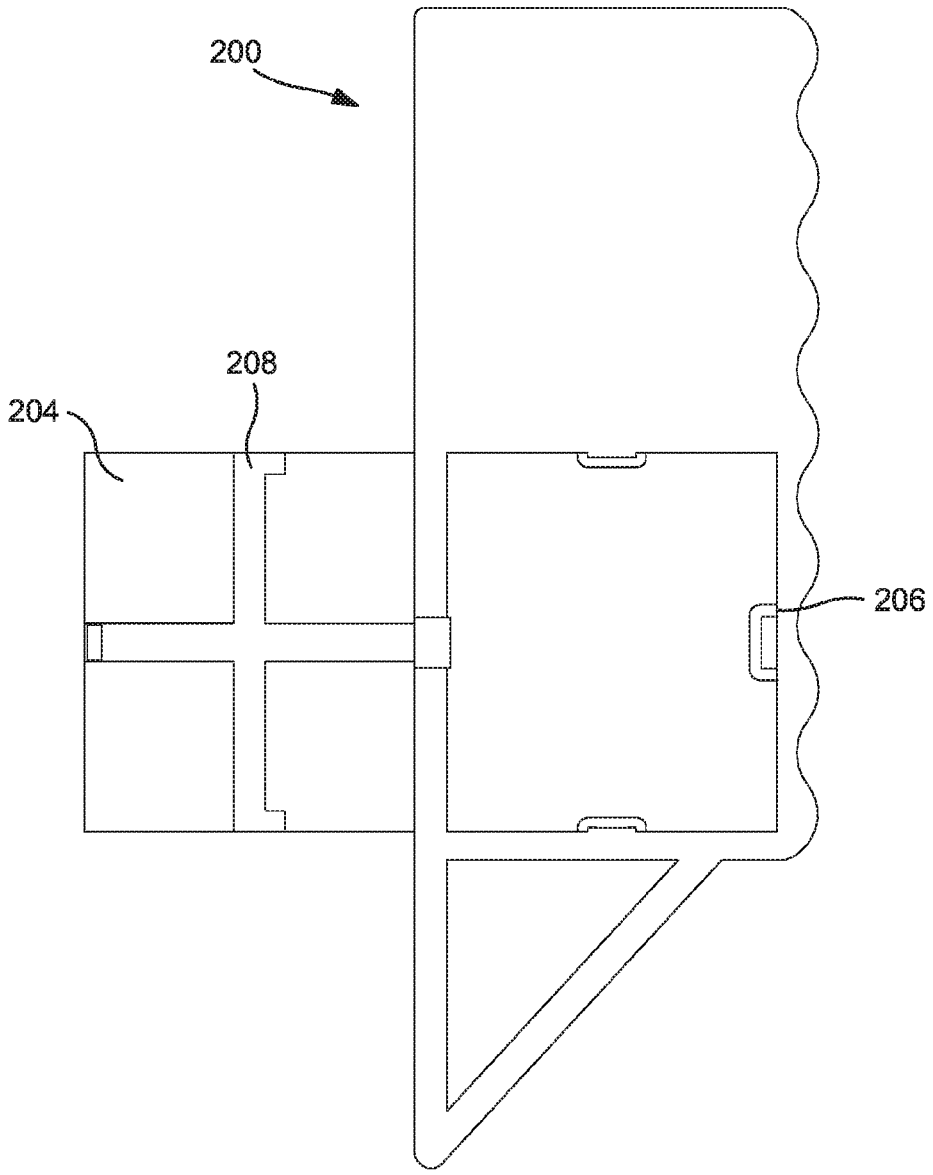
FIG. 2*b* is a left side wall cage view of an exemplary embodiment as opened with the top half of the outside frame covered by canvas.
Figure 2C:
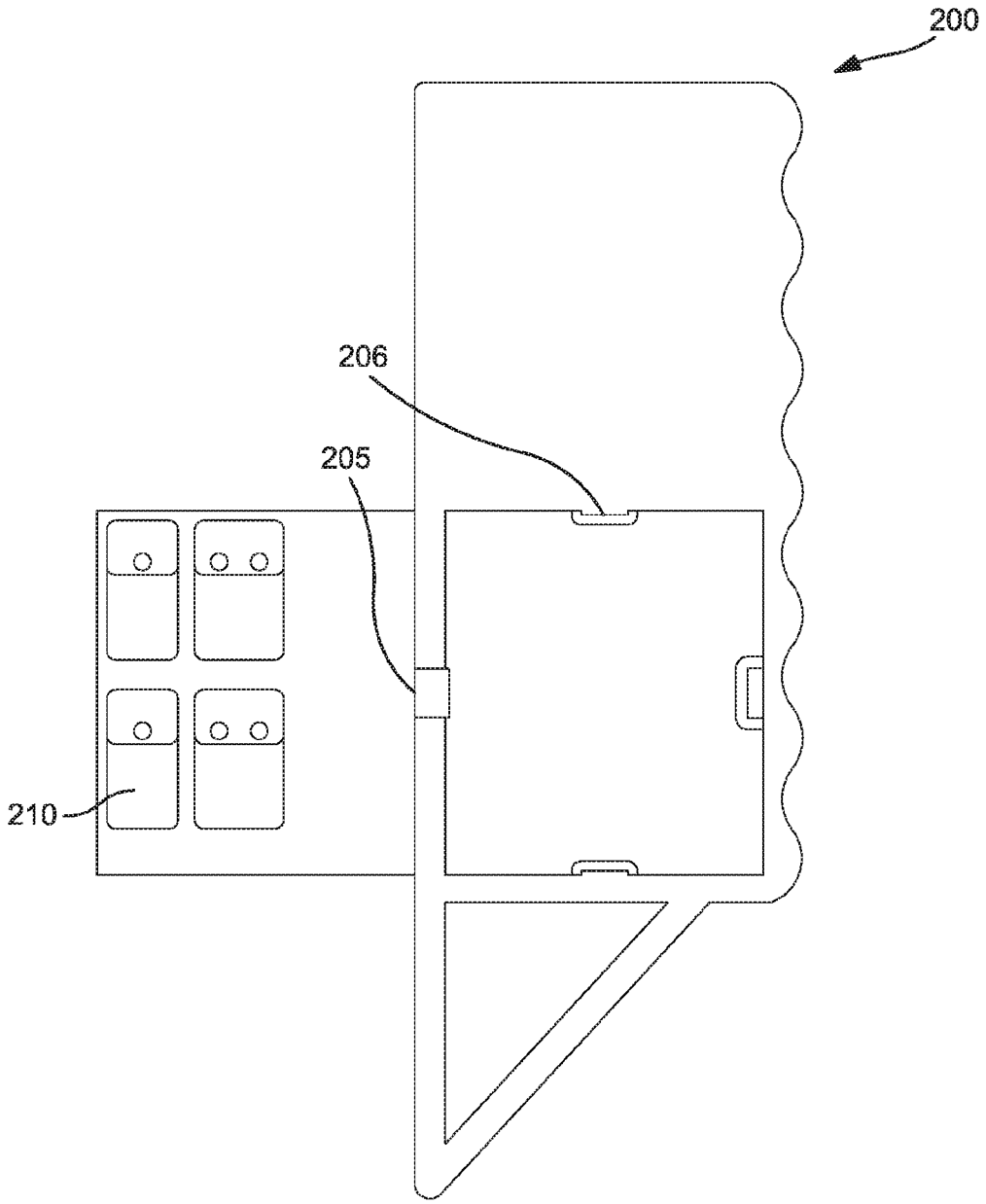
FIG. 2*c* is a left side wall cage view of an exemplary embodiment as opened showing hanging equipment with the top half of the outside frame covered with canvas.
Figure 2D:
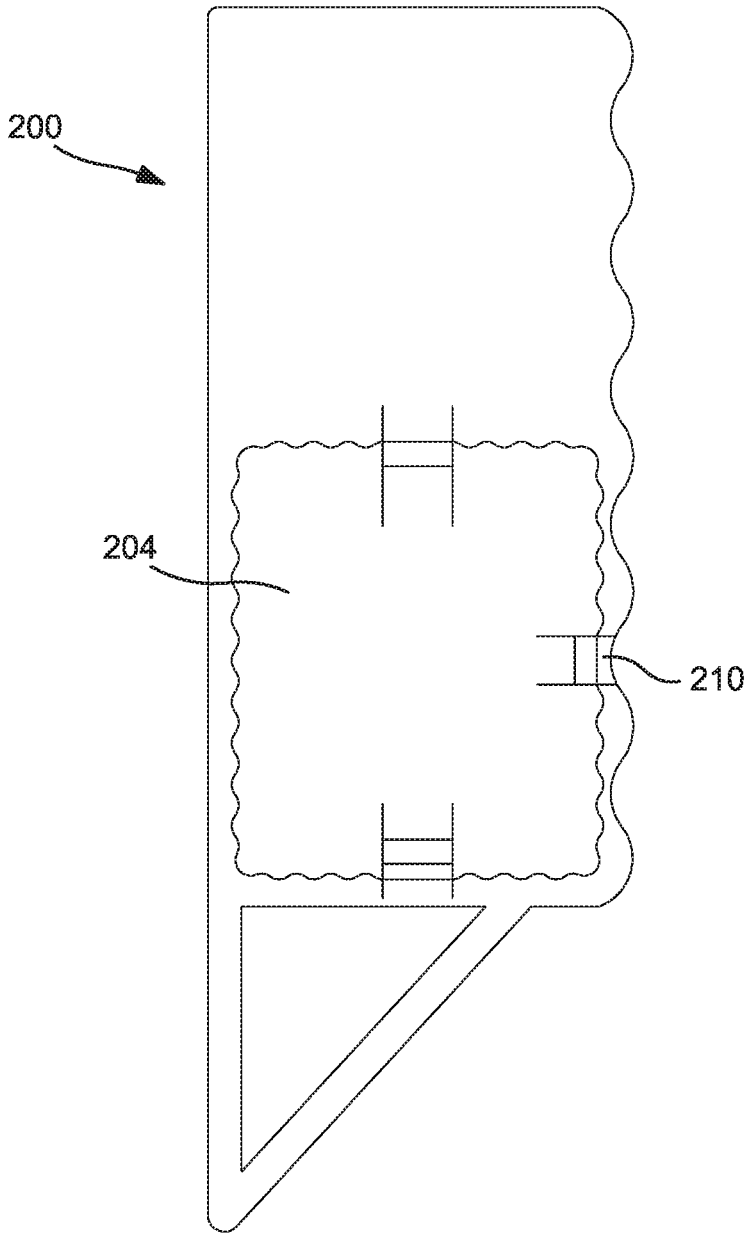
FIG. 2*d* is a view of a left sidewall cage door in closed/secured position in an exemplary embodiment.
Figure 5:
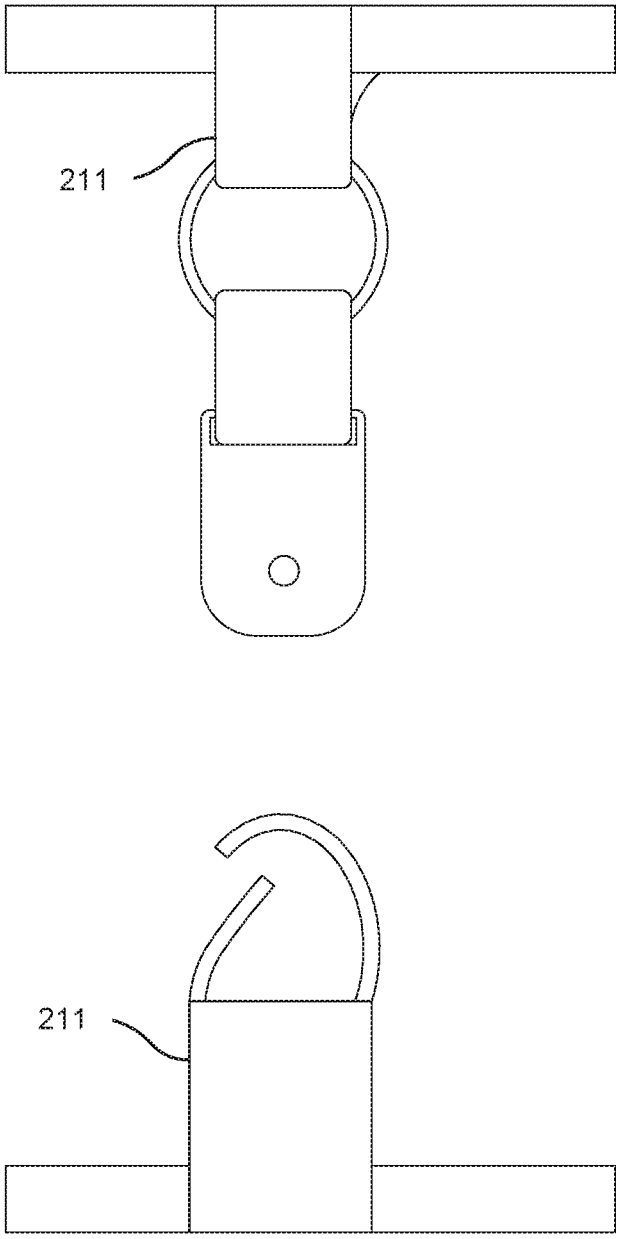
FIG. 5 is a view of a buckle system in an exemplary embodiment.

FIG. 2*b* depicts door 204 in an open position and FIG. 2*c* depicts door 204 having an inner covering with pouches 210 secured to the inner surface of door 204. One of skill would understand in view of the present teaches that doors of various sizes may be employed to meet a particular need, such as gaining access to equipment faster or keeping equipment separated. For example, a single large door may be used, or a plurality of doors of virtually any size and shape and may be installed and configured from any direction or area on the pack. Door 204 may further be held closed by buckles 211 (FIG. 5) to prevent door 204 from inadvertently opening when pack 100 is in transit. Example buckles 211 are depicted in FIG. 5. As shown, a buckle 211 on a first end may not have a middle circular ring and be held in place with just nylon webbing wrapped through a rounded edge rectangular piece of slim fat steel with a hooking hole or tough slim metal that passes through anchors 606 to connect with a strap on the other side. It should be apparent to one of skill in the art that any buckle 211 can be used with pack 100 as long as it is durable and can survive repeated/rough use.

Referring back to FIG. 2*a*, the left sidewall cage frame 200 may further comprise action weapon holder grooves 212. The action weapon holder grooves 212 may help hold rifles and other weapons. Holder grooves 212 may be placed anywhere around/in the pack and vary in size for different weapons.

Figure 3:
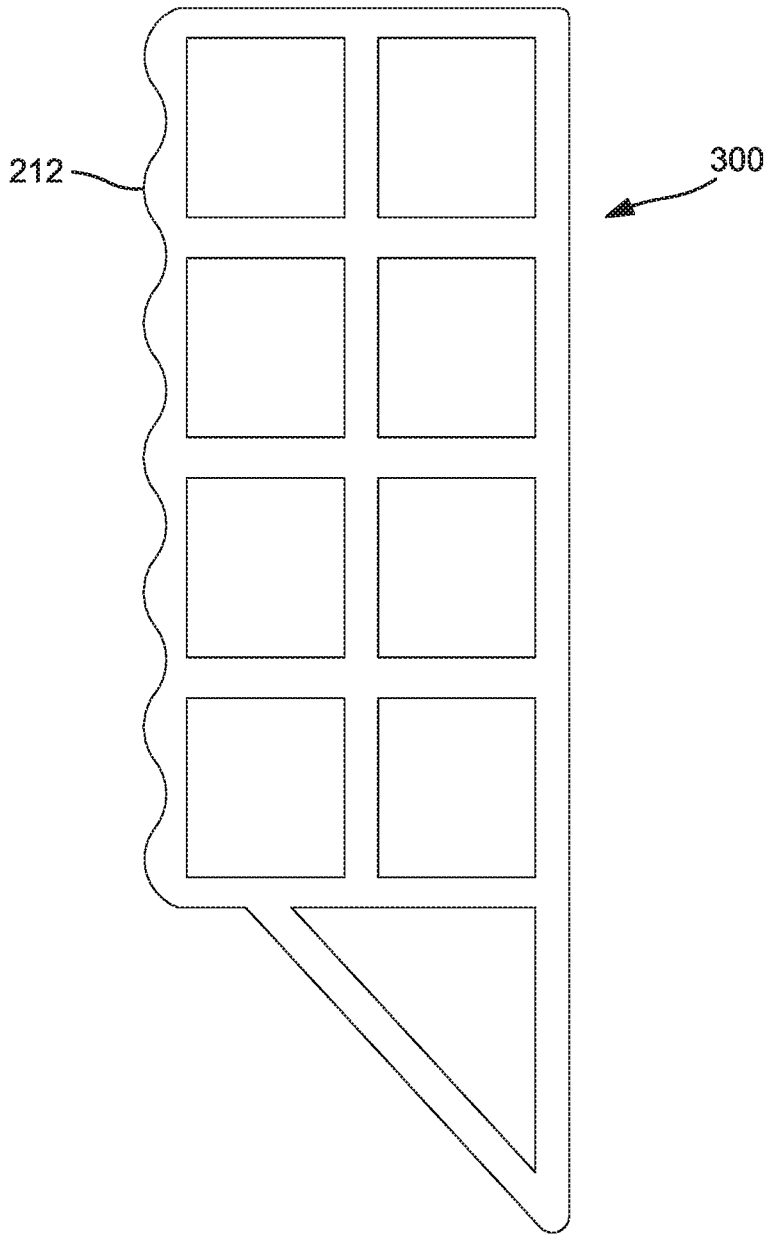
FIG. 3 is an interior view of a right sidewall cage frame as found in an exemplary embodiment.

FIG. 3 depicts right sidewall cage frame 300. The right sidewall cage frame 300 may duplicate the look/function of left side wall cage 200 with/without swinging door 204 and may comprise action weapon holder grooves 212 which may vary in size, shape, location, and quantity on the right sidewall cage frame 300.

Figure 4:
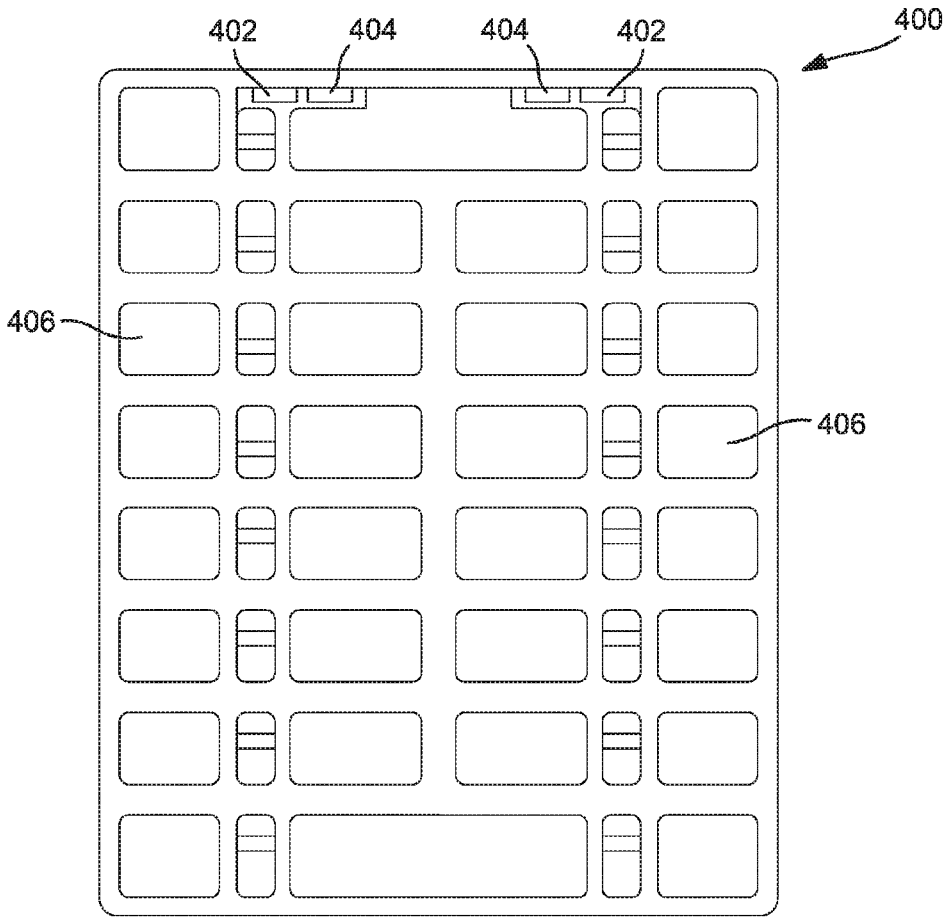
FIG. 4 is a interior view of a back wall cage barrier frame found as detached in an exemplary embodiment.

FIG. 4 illustrates a front view of the back wall barrier 400. Back wall barrier 400 comprises connection points 402 and 404 which are used to attach should straps and carrying handle 108, respectively, to pack 100. Back wall barrier 400 also includes a plurality of rectangular or square openings 406 which reduce the weight of back wall barrier 400 and help to keep the back of a user cool.

Back wall barrier 400 may further comprise padded sleeves or cushioning made of foam, rubber, or other material that helps with or acts as padding/suspension. The padded sleeves/cushion may comprise of soft stuffed-fabric material with/without suspension system underneath or on top of the fabric. Example metallic, coil springs or shape forming foam, memory foam, beans, sand, corn holes, pellets, ball bearings with the outside fabric being tougher denier nylon that may be flame retardant and use suspension/dispersion of energy for cushioning. The padded sleeve/cushion may be secured to the barrier protection tubes 10 by looping itself around the barrier protection tubes with buttons. The padded sleeves or other cushion may be placed on many parts of the pack to help minimize shock or force.

Figure 6A:
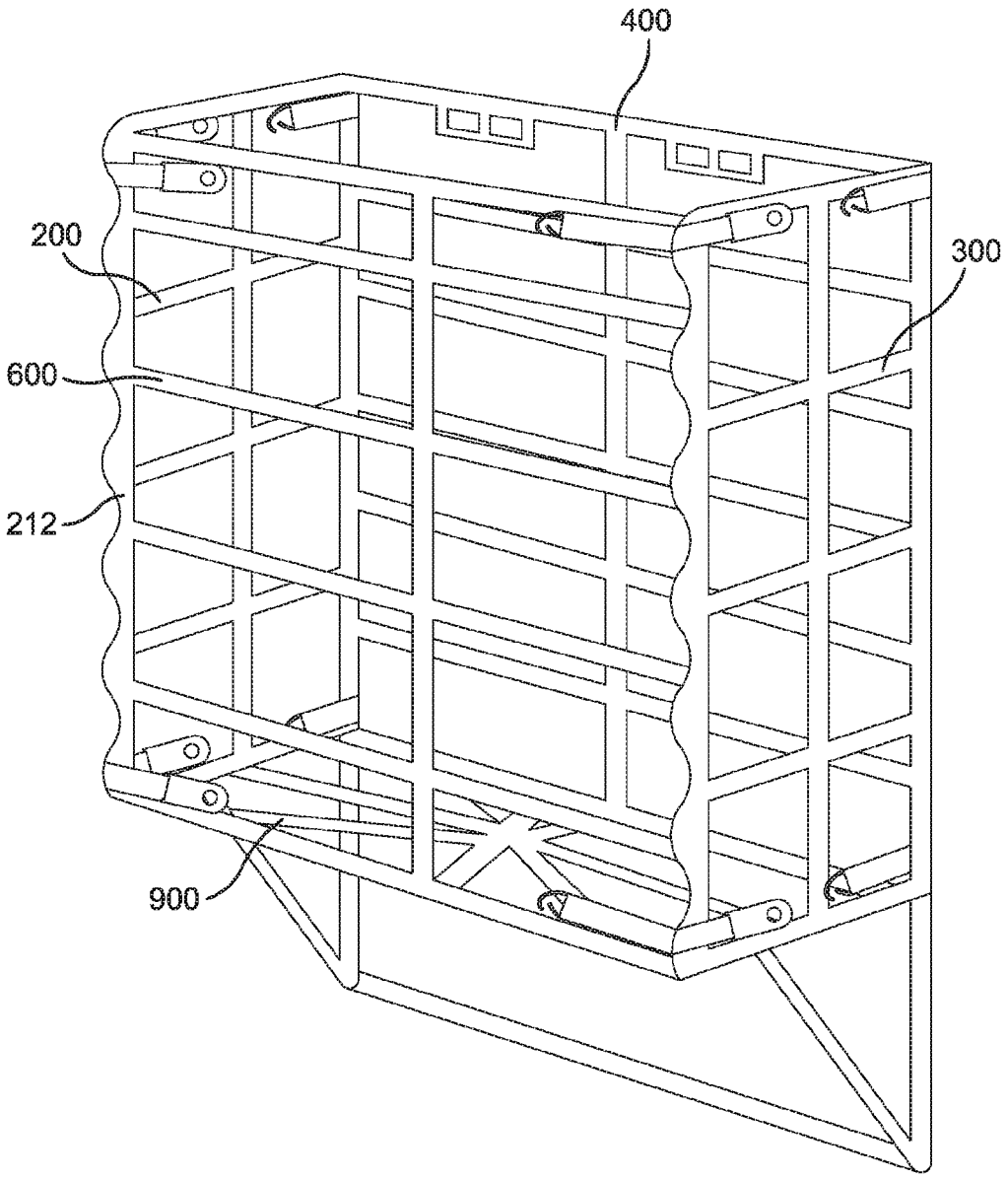
FIG. 6*a* is a rear exterior view of an exemplary embodiment with the buckle system attached.
Figure 9B:
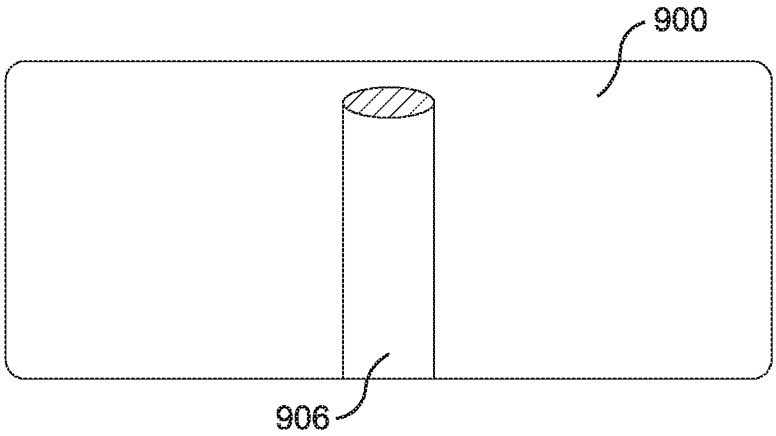
FIG. 9*b* is a sectional view of the structural star of FIG. 9*a* covered in canvas, with a monopod holder sleeve attached.

FIG. 9*a* depicts shelf 900 which serves as the weight bearing bottom of the interior of pack 100 (FIG. 6*a*). Shelf 900 is formed of an exterior rectangular frame 902 which are reinforced by beams 902 arranged in a star pattern. This arrangement of beams 902 helps keep back wall barrier 400 from bending under a load and also helps to dissipate energy to other sections of pack 100 through the beams 902. As shown in FIG. 9*b*, a cover and or a piece of plastic sheet may be placed over shelf 900 on the inside of the main compartment of pack 100 to prevent equipment/ammo from falling through the openings between beams 902.

Left sidewall cage frame 200, right sidewall cage frame 300, shelf 900, and back wall barrier 400 can be cut from a single piece of flat metal using a water jet machine and then folded/bent together. Alternatively, the pieces can be manufactured separately and then welded together to form the frame of pack 100. In another embodiment, the pieces may be connected to each other by hinges, allowing left sidewall cage frame 200 and right sidewall cage frame 300 to swing out from back wall barrier 400.

FIG. 6*a* shows the pack of FIG. 1*a* with outer fabric shell 102 removed to reveal the inner frame which is comprised of left sidewall cage frame 200, right sidewall cage frame 300, back wall barrier 400, shelf 900, and front wall barrier 600. Front wall barrier 600 is similar to back wall barrier in size and in construction. The various elements of the frame can be connected together by hinges, allowing pack 100 to be collapsible, or can be permanently attached/welded to each other for added strength.

Figure 8A:
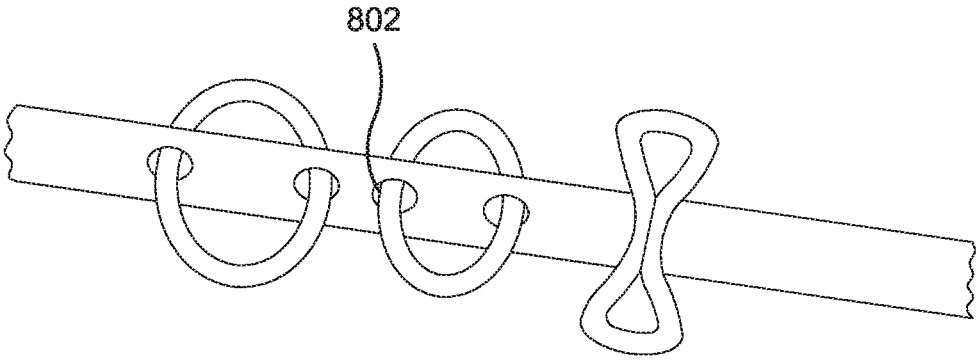
FIG. 8*a* is a top view of a holes formed in the frame of the pack used to secure items to the pack.

The pack 100 may comprise strips of durable fabric (e.g., connector straps 106) that are sewn or attached to the outer fabric shell 102 at any location (e.g., through holes 802 shown in FIG. 8*a*). The strips of durable fabric may be thick or thin (as guided by the particular need) and made to stick, grip, and/or stretch. The strips of durable fabric may comprise looped ends that freely hold a ring 602, and may be freely attached at one end to connector straps 106. The tail end of connector straps 106 closest to the another connection of opposing connector strap 106 may be a buckle, clip, button, or other connection device. Rings 602 may be cloth strips attach to the fabric's outer shell and can be shown in FIGS. 5/6*a*/6*b*.

The ring 602 may comprise a metal circle or other combinations of materials and shapes that allow the snap connector straps 106 to move freely about the ring 26 with little strain or friction. The rings 602 may also connect to snap connector straps 106 with integrated extension straps for strap length adjustment. In some embodiments, braces may also be connected to the frame of pack by any means and may slightly protrude out of the inner frame to the outer fabric shell 102.

Pack 100 may further comprise a wire, mesh, or other flexible, protective material running horizontally along the center of the pack to help facilitate action weapon holder grooves 212. The action weapon holder grooves 212 may comprise half-moon-shaped extrusions, recesses, or other-shaped extrusions/recesses, that may absorb shock and recoil of a weapon and may be malleable in the left sidewall cage frame 200 and right sidewall cage frame 300. The area of the pack provided by weapon holder grooves 212 can be used to secure weapons and other equipment. The weapon holder grooves 212 may be vertically or horizontally placed in the edges of the frame with variations in diameter and quantity of weapon holder grooves 212. There may also be one whole or portion of an edge on 200 and 300 that is without a groove. Different materials, such as carbon fiber, carbon fiber/fiberglass mix, extra cotton, rubber, foam or other materials, may be added or attached to weapon holder grooves 212 to better help with recoil/shock absorption.

Figure 6B:
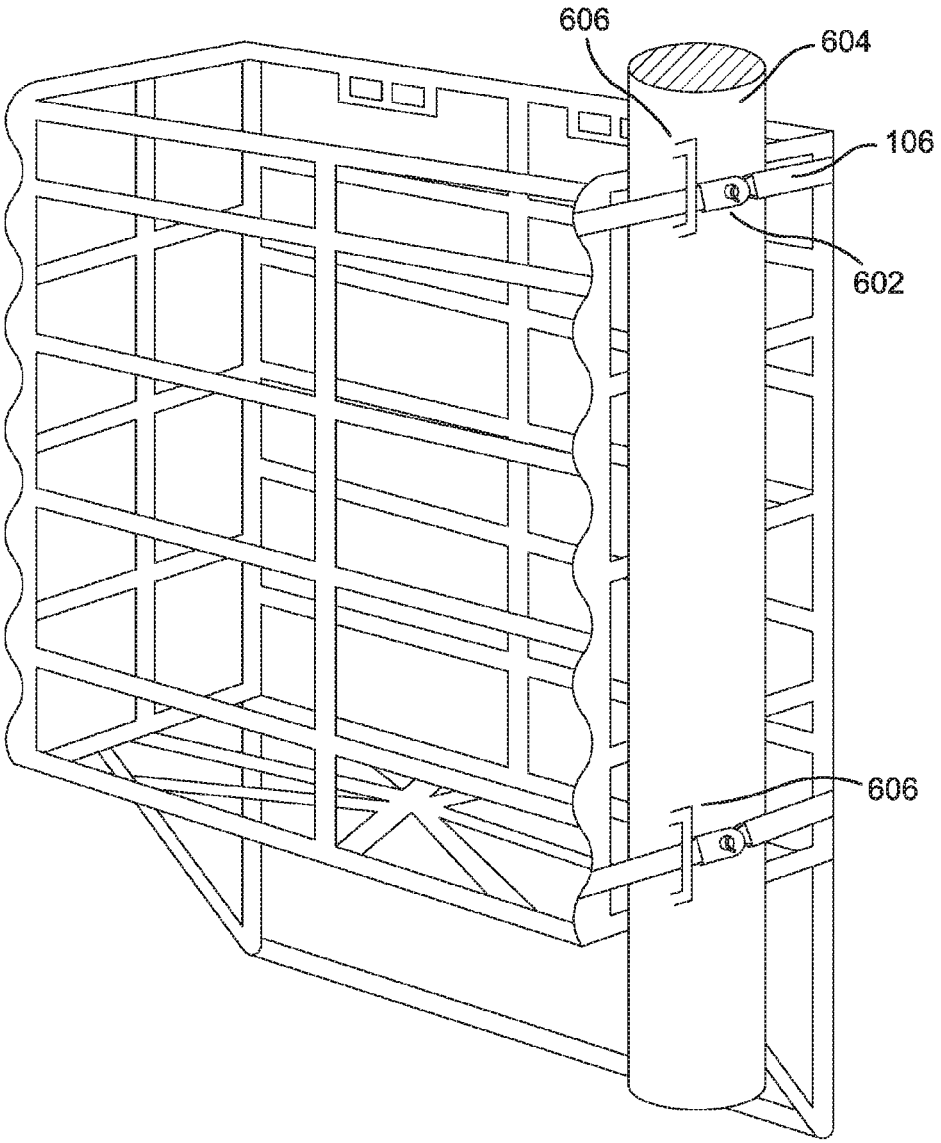
FIG. 6*b* is a rear exterior view of an exemplary embodiment securing a shoulder-fired weapon using a buckle system.

FIG. 6*b* shows a method of holding a shoulder fired weapon 604 with one or more durable fabric straps that may attach to the inner frame and have rings 602. Rings 602 may have a strip of durable fabric attached with connector straps 106 connector 3. connector straps 106 may run through at any angle and pass between and through the holder strap area/carrying attachments 606 of a shoulder fired weapon 604 to attach to any opposing connector strap 106. The carrying attachment 606 may refer to, for example, a shoulder fired weapon system's anchors, which may be positioned at opposite ends of the weapon and used to hold a user's carrying strap. Rings 602 may also be replaced or included in addition to a metal plates (formed from aluminum, steel, or any other tough metal) attached to connector straps 106 which passes through carrying attachment 606. The weight of the shoulder fired weapon 604 will potentially hold on braces attached to frame, inner frame, rings, and strong LBS rated Spectra or other stitching. Any material is acceptable for items listed above and any snap connector that buckles, snaps, hook loops and fastens, sticks, grips and clips that does the job of securing and holding is acceptable as long as it passes through a belt/holder loop or through its carrying attachments 606. The buckles or variations of attachments connected to the snap connector strap 106 may be in any shape, size and quantity. A strip of durable fabric may be secured to rings 602 by, for example, spectra, Kevlar, nylon or any other thread and material. The rings 602 may be machine stamped, welded or attached in any way and be any shape, size, and material. The snap connector 3 fabric strip may be attached to the inner frame without a ring 602. Height adjustment could be based on amount of slack given by adjustable strips on the connector straps 106. To help facilitate an easier route, the connector strap 106 and metal plate may be changed inn thickness, density, attachments or any other way.

Figure 7:
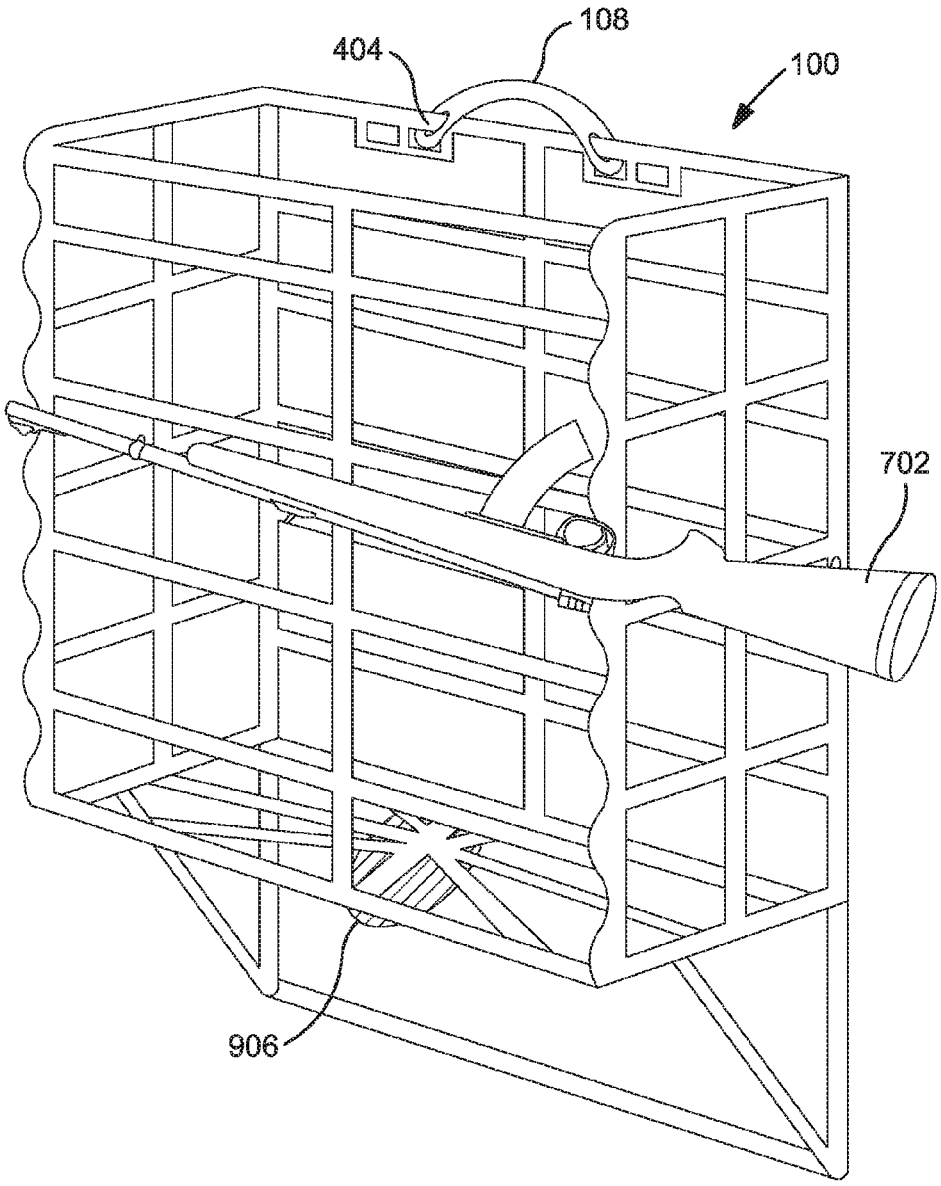
FIG. 7 is a rear exterior view of an exemplary embodiment securing a rifle while also facilitating a monopod holder sleeve and carrying handle.

FIG. 7 illustrates a view of the pack 100 as worn with a rifle 702 secured within the action weapon holder grooves 212. Holder grooves 212 could be bouncy, soft, or have shock absorbing qualities to it to help with dispersion, absorption or recoil of a weapon/equipment. The pack 100 of FIG. 7 may comprise a carrying handle 108 that may comprise a piece of durable fabric woven through two support braces 404 attached to the back wall barrier 400. The carrying handle 108 may be woven through the support braces 404 and woven back on itself one or more times to strengthen the carrying handle 108.

Ballistic protection may be in any form, such as, for example, ballistic nylon, ballistic plastic, Kevlar, combination of these and other materials, compressed, sewn, or just attached to the container frame or any part of the pack to help shield against accidental discharge of grenades or smoke grenades and other sensitive materials. There could also be padding that may be wrapped around/attached to the tubes in any form or formation combined with any durable fabric or material for protection with/without a suspension system. The suspension system may be any suitable suspension as long as it provides absorption, reflection, dispersion, reduction, expelling or containing blast of energy helping to protect equipment/belongings. There may be pockets/small bags any size lining inside or out of the container frame to help with ballistic or barrier protection. Soldiers may place flak, Kevlar, ballistic plastic, nylon or any other protective material inside a pouch or pocket attached to the container. Ballistic protection may also double as protection and suspension. For example, beanbags placed in or around pack 100 which are filled with pieces of soft ballistics can help providing cushion and protection. Outer fabric 102 may additional comprise foam with ballistic padding compressed or extended at any side or angle and may be on one or all sides. Ballistic protection may be connected to container permanently or may be detachable with snaps, buckles or anything else that can be connected.

Figure 8B:
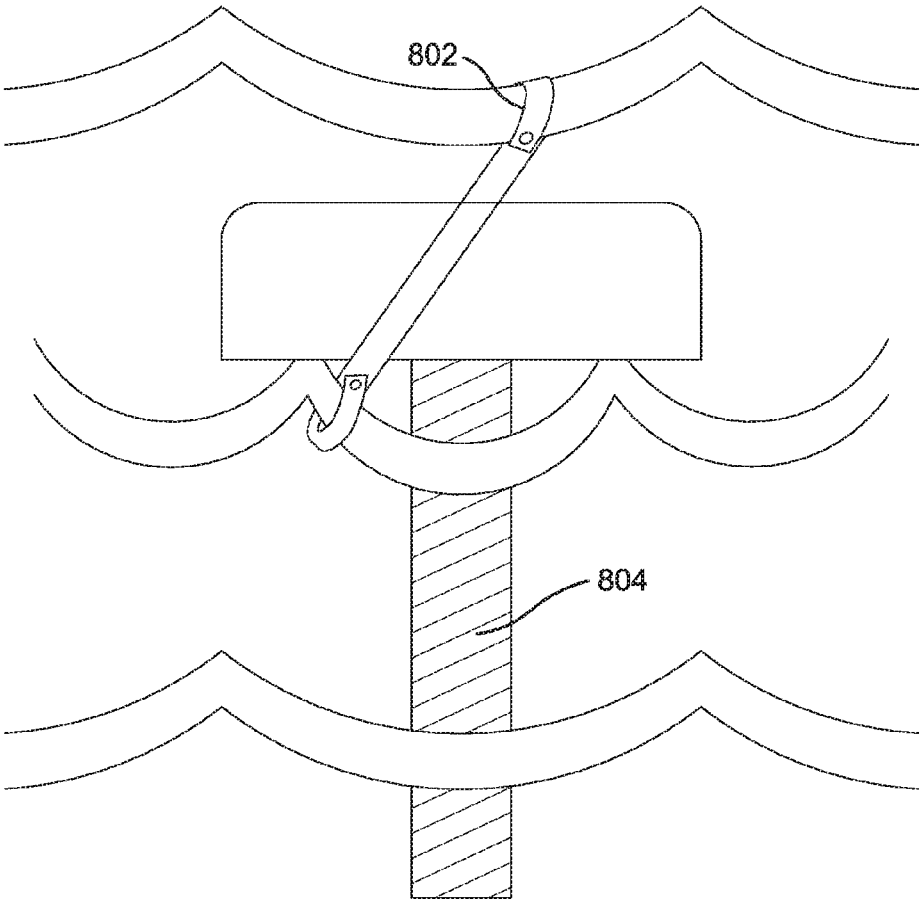
FIG. 8*b* is a perspective view of a hammer held in place by hanger loop a doops threaded through holes in the frame of the pack.

FIG. 8*a* depicts holes 802 which have been cut through the beams of any of the pack frame (e.g., left sidewall cage frame 200). The holes 802 are preferably water jetted holes that have pieces of durable nylon webbing or fabric woven through or wrapped around and secured on it self of the pack 100 to help hold equipment and tools on the interior/exterior sides. For example, as depicted in FIG. 8*b*, a hammer 804 is shown held using holes 802 and pieces of durable nylon webbing.

The interior of monopod pocket 114 is depicted in FIGS. 7 and 9*b*. As shown, the monopod pocket 114 is located directly below shelf 900 and contains monopod holder sleeve 906 which can be closed using closure 112. Monopod pocket 114 can also be used to store other items, such as a sleeping bag. Monopod sleeve holder 906 is preferably formed from a fabric or could be metallic ring/s that are circular and line up to be attached to beams 902/904 on shelf 900 to hold, mono/bi/tripods. Monopod sleeve holder 906 can also be used to hold attachments for weapons. In some embodiments, monopod sleeve holder 906 is attached to outer fabric shell 102.

Keeping present embodiment in mind with all four sides of pack 100 enclosed in a box like fashion, the pack may collapse all together with interior shelf collapsing at the same time by pulling twisting or unlocking twisting/untwisting screws, cotter pins, levers that self lock or are manual. Left sidewall cage frame 200, right sidewall cage frame 300, back wall barrier 400, front wall barrier 600, or shelf 900 may be connected via joints or hinges so that pack 100 is collapsible.

The foregoing description and accompanying Figures illustrate the principles, preferred embodiments and modes of operation of the invention. However, the invention should not be construed as being limited to the particular embodiments discussed above. That is, additional variations of the embodiments discussed above will be appreciated by those skilled in the art. Therefore, the above-described embodiments should be regarded as illustrative rather than restrictive. Accordingly, it should be appreciated that variations to those embodiments can be made by those skilled in the art without departing from the scope of the invention as defined by the following claims.

All documents cited herein, including journal articles or abstracts, published or corresponding U.S. or foreign patent applications, issued or foreign patents or any other documents are each entirely incorporated by reference herein, including all data, tables, Figures and text presented in the cited documents.

What is claimed is:

1. A pack configured to be carried on a back of a user, the pack comprising:

an outer fabric shell having a top flap foldably coupled thereto; and a frame assembly, said frame assembly comprising:

a back wall barrier;

a first sidewall cage frame coupled to the back wall barrier;

a second sidewall cage frame coupled to the back wall barrier; and a front wall barrier coupled to the first sidewall cage frame and the second sidewall cage frame, wherein the outer fabric shell is configured to cover said frame assembly, wherein a front edge of the first sidewall cage frame comprises a plurality of first holder grooves extending past the front wall barrier, wherein a front edge of the second sidewall cage frame comprises a plurality of second holder grooves extending past the front wall barrier, wherein the outer fabric shell is has a shape that conforms to the shape of the first holder grooves and the second holder grooves, and wherein at least one of the plurality of first holder grooves corresponding to one of the plurality of second holder grooves such that an elongated object can be held by each of the corresponding grooves; and a carrying structure for the user to carry the pack on the back.

2. The pack of claim 1, wherein at least one of the plurality of first holder grooves is half-moon shaped.

3. The pack of claim 1, wherein at least two of the plurality of first holder grooves are different shapes.

4. The pack of claim 1, wherein at least a portion of the front edge of the first sidewall cage frame is straight.

5. The pack of claim 1, wherein the first sidewall cage frame or the second sidewall cage frame comprises an opening and a door for covering the opening when the door is in a closed position, wherein the door is coupled to the first sidewall cage frame or the second sidewall cage frame by a hinge, and wherein the door is secured in the closed position by grippers on the frame assembly.

6. The pack of claim 5, wherein the hinge comprises a stopper to limit rotation of the door when in an open position.

7. The pack of claim 5, wherein at least one pouch is coupled to an interior of the door.

8. The pack of claim 5, wherein the outer fabric shell comprises a flap at the location of the door to allow the door to open, and wherein the flap comprises at least one closure for securing the door in a closed position.

9. The pack of claim 1, further comprising a shelf secured in an interior of the frame assembly for dividing the interior of the frame into a first section and a second section.

10. The pack of claim 9, wherein the first section can be accessed by opening the top flap and the second section can be accessed by opening a closure formed along a bottom of the pack.

11. The pack of claim 9, wherein the shelf is formed of an exterior rectangular frame reinforced by beams arranged in a star pattern.

12. The pack of claim 9, wherein a top of the shelf is covered with a solid cover and a sleeve is secured to a bottom of the shelf.

* * * * *